US006085647A

United States Patent [19]

Burow

[11] Patent Number: 6,085,647

[45] Date of Patent: Jul. 11, 2000

[54] LAWN WASTE DISPOSAL

[76] Inventor: Paul D. Burow, 1320 Briarcliff, Rantoul, Ill. 61866

[21] Appl. No.: 09/151,138

[22] Filed: Sep. 10, 1998

[51] Int. Cl.[7] ..... B30B 15/06

[52] U.S. Cl. ..... 100/295; D7/700; 100/265; 141/390; 141/391; 248/94

[58] Field of Search ..... 100/215, 226, 100/229 A, 240, 245, 265, 295; D7/700; 141/331, 337, 340, 390, 391; 248/94

[56] References Cited

U.S. PATENT DOCUMENTS

| | | | |
|---|---|---|---|
| D. 29,377 | 9/1898 | Brubaker | D7/700 |
| 2,524,243 | 10/1950 | Wicklund | 248/94 |
| 2,827,931 | 3/1958 | Melvin | 141/331 |
| 4,273,167 | 6/1981 | Stillwell | 141/391 |
| 5,048,778 | 9/1991 | Wright | 141/391 |
| 5,765,614 | 6/1998 | Kardosh | 141/390 |
| 5,868,364 | 2/1999 | MacMillan | 141/391 |
| 5,871,037 | 2/1999 | Feldt | 141/391 |

*Primary Examiner*—Stephen F. Gerrity
*Attorney, Agent, or Firm*—Robert M. Wolters

[57] ABSTRACT

A packer as provided for lawn waste disposal for compacting and channeling it into a throwaway bag. The disposer includes an upper portion with converging walls and a lower portion with parallel walls forming a chute into a bag. The entire structure is made of sheet polyethylene and it is entirely rectangular in outline. The upper portion, the converger, is only one-half the height of the lower portion, the chute, to prevent overbalancing. The chute is polyethylene, of which the disposer is made, is reinforced at discrete locations, the converging edges and the bottom edge, of plastic of the same type from which the disposer is made to keep the disposer light in weight, yet strong. A folding metal frame supports the disposer at bag height.

3 Claims, 1 Drawing Sheet

LAWN WASTE DISPOSAL

BACKGROUND

Many people mow their lawns with power mowers, and collect the waste. The problem then becomes, what to do with it. There are bags that can be loaded from the lawn mower, but these are for the most part round bags. There are rectangular bags on the market, but they need a funnel for filling the bags. There are also larger bags that are rectangular in nature, and on the order of tabletop height, i.e. 32–34 " from top to bottom. These bags have an opening at the top of about 12"×16". There are large funnels for filling such bags, but all of those of which I am familiar are round.

It has occurred to me that I could build a rectangular funnel to fit the bags. However, this presents problems. If made of metal, the funnel could easily cut the bags which are conventionally made of paper. Making the bags of plastic would not do, as it is desired that the lawn leaves gathered up and their container should disintegrate with the weather when buried.

Other problems come to mind. A rectangular funnel made of rigid metal would be prohibitively heavy, and would mark anything it came in contact with. Going to a plastic construction is not an easy solution, since making the funnel of lightweight plastic would result in a flimsy construction that would not last very long, and would flop around, thus making long service life improbable. Making the funnel of heavier weight plastic is not the answer, as this would be prohibitively expensive, and would make the device more heavy to handle.

Making the funnel of metal would cause wet leaves to tend to pack in the funnel leading to jams. Furthermore, metal is notoriously not slippery, and it would be difficult to load the leaves with a metal funnel. A tamper would bend the metal out of shape. A plastic construction of the funnel is not the answer, either, since it would be too large to make of sufficiently heavy plastic without greatly increasing the weight, and also making it difficult to move around.

OBJECTS AND SUMMARY OF THE PRESENT INVENTION

An object of this invention is to provide a plastic rectangular funnel for loading leaves into a storage bag. The mutually incompatible requirements of size, weight, and rigidity are solved providing self-rigidifying ribs in the plastic material, thereby leaving relatively thin sheet plastic construction, with no flimsiness nor lack of strength and rigidity, while still leaving the funnel of sufficiently thin sheet material which is economical and easy for the public to buy.

I have constructed a sample of polyethylene, although I am aware that other materials could be used. The top or funnel shaped portion is rectangular, and the four converging edges are reinforced. The material is 1/16" thick, while the reinforcement ribs at the corners are 1/8" thick. This does not greatly increase the cost, or weight, while leaving the structure economical. The funnel portion is limited in height, and is only about half the dimension of the deep ended portion having straight sides. This portion could be expected to flop around, but the corners are reinforced by sections of sheet plastic, and the bottom edges are thickened. Again, the walls are made of 1/16" thick material, while the ribs at the bottom are about 1/8" thick. The depending portion is deep enough that it extends far enough into the bag that there is no danger of spillage. A handle is formed in one of the side walls of the funnel portion by making a hole in it. This is sufficient for lifting the funnel, and yet it does not unduly weaken it.

THE DRAWINGS

A study of the specifications along with the accompanying drawings will render the invention completely clear. The drawings comprise:

DETAILED DISCLOSURE OF THE ILLUSTRATIVE EMBODIMENT

Figure 1:
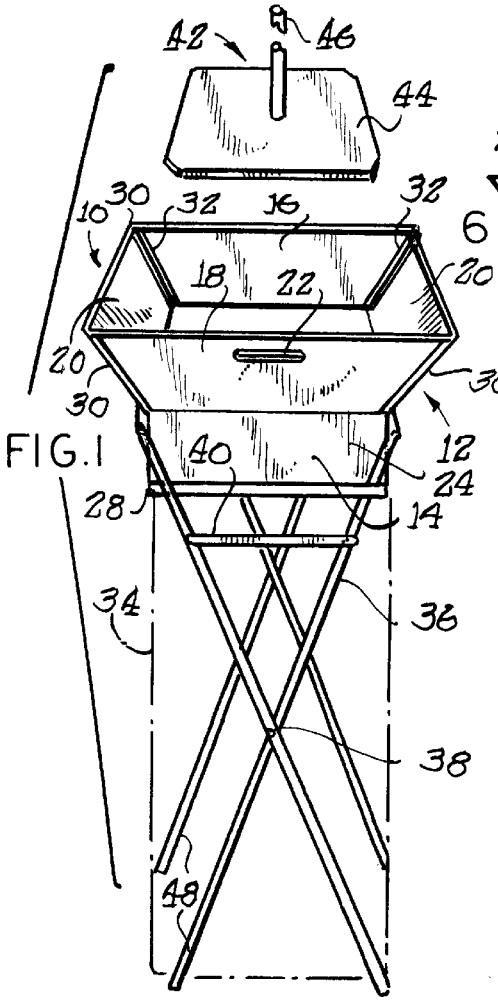
FIG. 1 is a perspective view of the entire funnel with a bag shown in fathom that is being filled.
Figure 2:
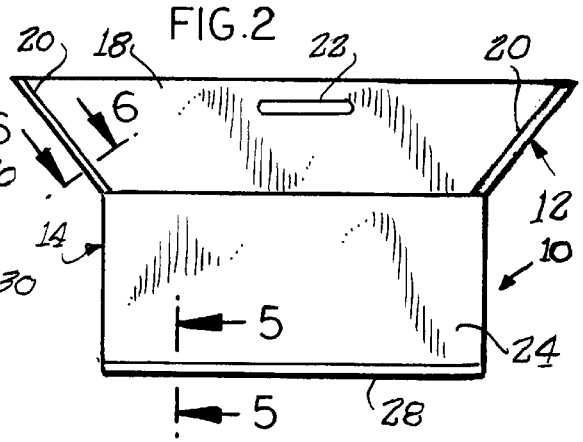
FIG. 2 is side view of the funnel.
Figure 3:
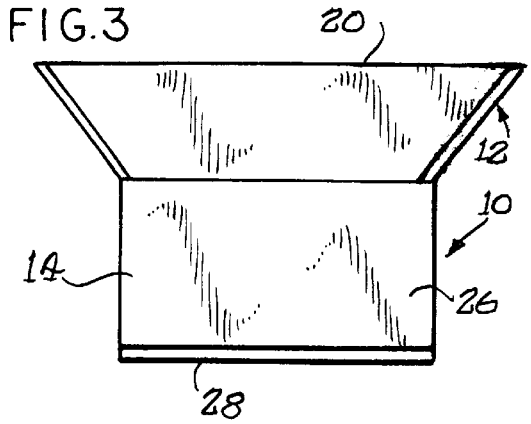
FIG. 3 is an end view of the invention.
Figure 4:
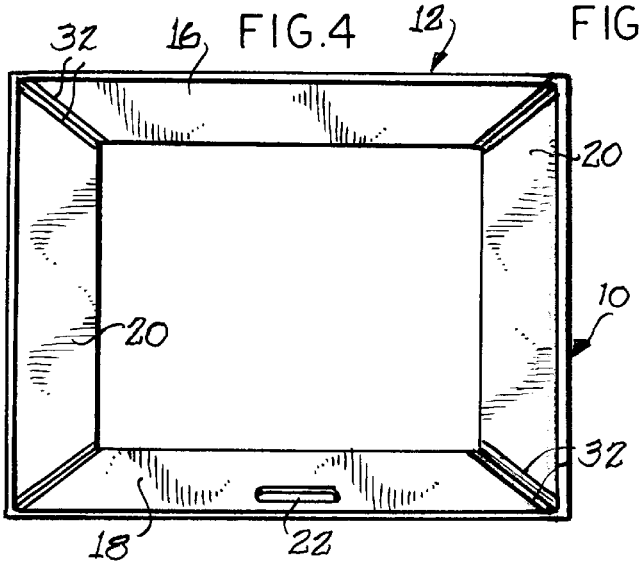
FIG. 4 is a top view of the invention.

Referring now to the drawings in greater specificity, there will be seen a funnel shaped device 10 which has a top or funnel shaped portion 12, and a straight sided depending portion 14. The top or funnel shaped portion 12 is 4" in height, while the depending portion 14 is 8" in height.

The top portion comprises a back 16 and a front 18, and two end pieces 20. The top 18 has a hole of oblong proportions formed in it at 22 as a handle.

The bottom or bag loading portion 14 has two identical side walls 24, and two identical end walls 26. The side walls 24 are 15" in length and 8" high. The end walls 16 are equal in length being 11" and the height being 8", like the side walls. The top long portions 16 and 18 are identical except for the hole 22, and have a maximum length of 23", the minimum length being 15". The end portions 20 of the top have a maximum length of 19", and the bottom is 11" as coincides with the side walls look the end walls of the base. All of the walls heretofore described have a 1/8" thickness.

Figure 5:
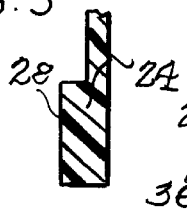
FIG. 5 is a view taken substantially along the line 5—5 in FIG. 2 to show the reinforcement of the side wall of the depending portion.
Figure 6:
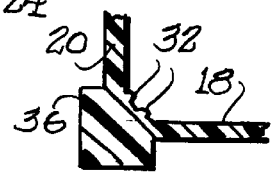
FIG. 6 is an angled section taken through the frontal portion substantially along the line 6—6 in FIG. 2.

On the outside of the side walls 24 and of the end walls 26 there is a 1" band 28 which is 1/8" thick. I have shown the band 28 and one of the side walls 24 in FIG. 5 as being integral, since they are integral with one another. The band lies on the outside of the sided end walls, and reinforces them.

Similarly, at each juncture of the walls 16 and 18 with the end walls 20 there is on the outside surfaces a reinforcing band running from top to bottom of the structure. The reinforcing band is like the parts it is integral with and is 1/8" thick, and has two right angle walls of approximately 1" wide. These, like the band 28, are integral with the front and back and end walls. There are reinforcements 32 on each of the front and rear, and end walls in the nature of ribs. These are made in welding the walls together. Again, I note that the model was all made of parts available to me.

However, in actual construction the entire funnel-like structure would be molded integrally. Therefore, there would be no separate parts. The reinforcing ribs 32 are thought not to be essential to the invention, and would probably be eliminated in a mold.

Be as it may, a plastic mold of size necessary to make the funnel is not difficult to make. The material will be molten at least during a part of the manufacturing operation. I leave it to those skilled in the art to determine just what type of mold will be used.

Finally, there is a portable support or structure to be used in holding erect a bag 34. This includes a pair of substantially unshaped members 36 held together by a pair of pivots 38. A pair of legs 40 is positioned atop the structure to hold it open. The leg has two ends, one of which is pivoted through an adjacent leg 36 of each pair thereof, and is inserted in the opposite leg 36 from the opposite direction. This holds the legs in erect position as shown in FIG. 1.

Finally, a wood tamper 42 is provided. It includes a base 44 which is ¼" thick and having dimensions of 10"×14", and a handle or rod 46 which is screwed into a hole in the tamper base, or which is held by a threaded stud or screw. Alternatively, the tamper may be made of polyethylene to make it consistent with the remainder of the funnel, or any other type material. It will be noted that the dimensions of the tamper base are just slightly less than those of the loading structure 14. The tamper is used to press leaves and other lawn waste through the funnel and into a bag. Leaves, even when wet, readily are compacted by the funnel, due to the angulation of the front and back walls, and the end walls of the funnel. A paper bag 34 does not have to be attached to the structure as shown in FIG. 1 but a rubber band may connect it if it is found necessary. The height of the bottom portion 14 of the funnel generally renders any fastening means superfluous.

The bottom ends of the legs 36 of the holder for the structure are shown as having plastic ferrules 48 on the lower ends thereof.

Figure 7:
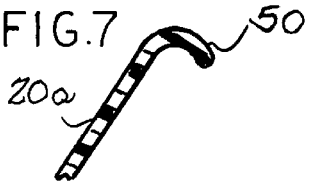
FIG. 7 is a sectional view through the edge of FIG. 4 as a modification.

A modification of my invention is shown in FIG. 7. When the entire structure of the lawn waste disposal is molded as one piece the top edge is continuous. This is shown in FIG. 7 as 50 where the edge as molded on the section 20*a* of the inclined wall is made integral with the chute and with the inclined walls 18, 20 and 16. The hole 22 also is omitted, and lifting of the structure is done by inserting the fingers into the curved section 50. The curve also forms the reinforcement for the flat walls. The inverted section of the curved portion serves as a doubling of the wall thickness.

I have now described my inventive loading structure in detail as will be understood by those skilled in the art. Various changes in structure may occur to those skilled in the art, but they will be understood as forming a part of the invention insofar as they fall within the spirit and scope of the appended claims.

The invention is claimed as follows:

1. An apparatus for disposing of lawn waste comprising means for compacting the waste, said means being larger at the top and converging toward the bottom, chute means below said compacting means and receiving compacted waste therefrom, said compacting and said chute means being made of sheet plastic material and being of rectangular outline and having joined rectangular edges, said joined rectangular edges having reinforcing means running along the joined rectangular edges and forming reinforcing means therefor, said compacting means being of substantially less height relative to said chute means, and said chute means being adapted to fit in the top of a disposable container.

2. An apparatus for disposing of lawn waste as set forth in claim 1, wherein the compacting means are comprised of flat panels joined to one another, and the junctures of said panels have thickened portions.

3. An apparatus for disposing of lawn waste as set forth in claim 2, wherein the panels of sheet plastic are thickened at discrete areas to form reinforcing means.

* * * * *